US006145931A

United States Patent [19]

Subotic

[11] Patent Number: 6,145,931

[45] Date of Patent: Nov. 14, 2000

[54] ARTICLE FOR USE IN PUTTING ON AND REMOVING SHOES

[76] Inventor: Slobodan Subotic, R.R.1, Shelbourne, Canada, L0N 1S5

[21] Appl. No.: 09/270,819

[22] Filed: Mar. 18, 1999

[51] Int. Cl.[7] ..... A47C 7/50

[52] U.S. Cl. ..... 297/423.2; 297/188.11

[58] Field of Search ..... 297/423.2, 423.23, 297/423.24, 188.11, 423.21, 423.14, 423.22; 312/348.5, 348.4

[56] References Cited

U.S. PATENT DOCUMENTS

| | | | |
|---|---|---|---|
| 155,016 | 9/1874 | Eberhard | 297/423.21 |
| 155,524 | 9/1874 | Lambert | 297/423.2 |
| 181,397 | 8/1876 | Beyron | 297/423.2 |
| 529,380 | 11/1894 | Halliburton | 297/188.11 X |
| 793,171 | 6/1905 | Bartlett | 297/423.2 |
| 1,216,172 | 2/1917 | Schulz | 297/423.21 X |
| 1,435,744 | 11/1922 | Santaniello | 297/423.2 X |
| 1,505,829 | 8/1924 | Warnecke | 297/188.11 X |
| 1,767,708 | 6/1930 | Simpson | 297/423.2 X |
| 2,628,879 | 2/1953 | Schultz | 297/423.21 X |
| 2,888,977 | 6/1959 | Thaden | 297/423.2 |
| 4,046,419 | 9/1977 | Schmitt | 297/423.21 X |
| 4,925,245 | 5/1990 | Pendleton et al. | 297/188.11 X |
| 5,524,957 | 6/1996 | Gibriano | 297/188.11 X |
| 5,524,964 | 6/1996 | Weimersheimer | 297/423.2 |

FOREIGN PATENT DOCUMENTS

| | | | |
|---|---|---|---|
| 452716 | 5/1913 | France | 297/423.21 |
| 1315414 | 12/1962 | France | 297/423.22 |
| 2664800 | 1/1992 | France | 297/423.21 |
| 270740 | 2/1914 | Germany | 297/423.2 |
| 505197 | 12/1955 | Italy | 297/423.2 |
| 373329 | 5/1932 | United Kingdom | 297/423.2 |

*Primary Examiner*—Peter M. Cuomo
*Assistant Examiner*—David E. Allred
*Attorney, Agent, or Firm*—Robert F. Delbridge

[57] ABSTRACT

An article for use in putting on and removing a shoe. The article includes a seat assembly including a seat resting above a support. The article further includes a foot rest assembly attached to the seat assembly, and a shoe support retained by the seat assembly. The foot rest assembly includes a foot rest positionable at a selected location in front of the seat assembly and angled upwardly towards the seat assembly to present an inclined surface to a person sitting on a seat of the seat assembly. The shoe support is positionable to extend horizontally and laterally outwardly of the seat assembly at a selected location. A person may therefore sit on the seat, pick up a shoe which is resting on the shoe support, and put it on his or her foot which is resting on the foot rest. Alternatively, the person can remove a shoe from a foot resting on the foot rest and place the shoe on the shoe support. The need to bend over to reach the ground for a shoe is eliminated through use of the article and a shoe rack. The foot rest assembly and shoe support may be retractable to improve the appearance of the article when it is not in use.

2 Claims, 4 Drawing Sheets

ARTICLE FOR USE IN PUTTING ON AND REMOVING SHOES

FIELD OF THE INVENTION

This invention relates to articles for use in putting on and removing footwear (hereinafter referred to as shoes).

BACKGROUND OF THE INVENTION

The act of putting on and removing footwear, such as shoes, often involves bending over to reach a shoe on the ground while sitting on a chair or standing. This can be a challenge to some such as the disabled, the elderly, and women in advanced stages of pregnancy. Others may simply find this act annoying and troublesome. An object of the invention is therefore to provide an article for use in and which facilitates the putting on and removing of shoes.

SUMMARY OF THE INVENTION

The invention provides an article for use in putting on and removing a shoe, the article including a seat assembly and a foot rest assembly attached to the seat assembly. The seat assembly has a support for resting on a ground and a seat above the support. The foot rest assembly has a foot rest and is positionable in an extended position in which the foot rest is spaced a selected distance in front of the seat assembly and above a bottom end of the seat assembly, the foot rest being angled upwardly towards the seat assembly to present an inclined surface to a person sitting on the seat, whereby the person can put his or her foot on the foot rest while putting a shoe on or removing a shoe from the foot.

The foot rest assembly may be positionable in a retracted position in which the foot rest is located under the seat.

The foot rest assembly may include a horizontally extendable and retractable arm having a first end rigidly coupled to the foot rest and a second end rigidly coupled to the seat assembly, the arm being extended when the foot rest assembly is in the extended position, and being retracted when the foot rest assembly is in the retracted position. The arm may be telescopic and include a plurality of tubular arm segments slidably arranged one inside another to extend in a horizontal and forward direction relative to a back of the seat assembly. The arm segments may be slidable forwardly to respective forward limits thereof to extend the arm, and may be slidable rearwardly to respective rearward limits thereof to retract the arm.

The article may further include a shoe support having an upper shoe support surface for supporting a shoe, the shoe support being retained by the seat assembly and positionable in a shoe supporting position in which the shoe support surface extends laterally outwardly of the seat assembly at a selected location above the bottom end such that a shoe placed upon the shoe support surface will be within reach of a person sitting on the seat, whereby the person may place a shoe on or pick up a shoe from the shoe support while seated.

The seat assembly may include a slide bearing disposed below the seat and defining a laterally and horizontally-extending slide passage. The shoe support may include a support board defining the shoe support surface and slidable laterally in the slide passage between a non-supporting position in which the shoe support surface is under the seat, and the supporting position in which the shoe support surface extends laterally outwardly from the seat assembly.

The seat assembly may further include a front wall, a back wall, and a pair of side walls extending between the front and back walls, the walls being coupled to and extending downwardly from the seat. The front wall may have an opening and the foot rest may be movable through the opening and under the seat between the walls whereby the foot rest assembly is in the retracted position. One of the side walls may have a side opening in communication with the slide passage. The support board may be slidable through the side opening and slide passage between the supporting and non-supporting positions. The foot rest assembly may further have a front cover member for covering the opening when the foot rest assembly is in the retracted position and the shoe support may have a side cover member which engages said one of the side walls to cover the side opening when the shoe support is in the non-supporting position, whereby the walls and the cover members cooperate to conceal the foot rest assembly and support board when the foot rest assembly and shoe support are in the retracted position and non-supporting position, respectively.

BRIEF DESCRIPTION OF THE DRAWINGS

A preferred embodiment of the invention will now be described with reference to the drawings in which.

DETAILED DESCRIPTION OF THE PREFERRED EMBODIMENTS

Figure 1:
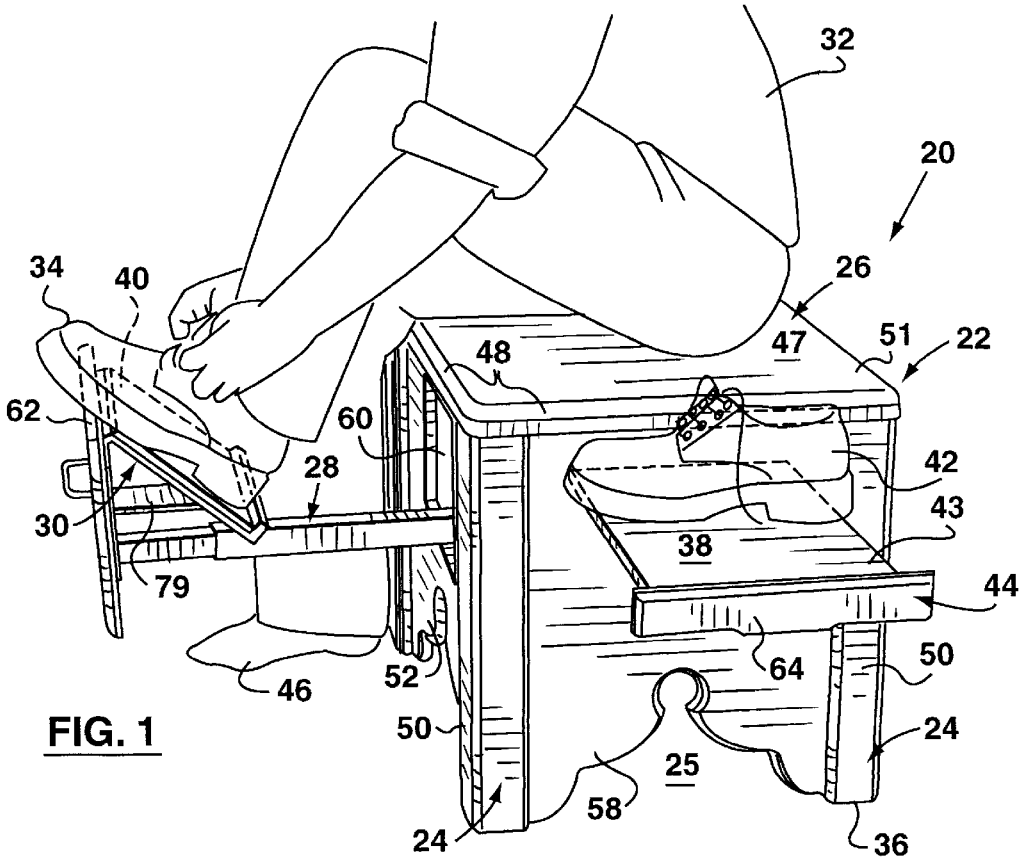
FIG. 1 is a perspective view of an article according to the preferred embodiment, from a front and a left side thereof, in use by a person, the article including a foot rest assembly shown in an extended position, and a shoe support shown in a supporting position.

Referring to FIG. 1, an article for use in putting on and removing a shoe, designated generally by reference numeral 20, is shown. The article includes a wooden seat assembly 22 having a four legged support 24 resting on a ground 25, and a seat 26 resting on the support 24. A foot rest assembly 28 is attached to the seat assembly 22, as will be described. The foot rest assembly 28 includes a foot rest 30 and is positioned in an extended position in which the foot rest 30 is spaced a selected distance in front of the seat assembly 22 and above a ground-contacting bottom end 36 of the seat assembly 22. The foot rest 30 is angled upwardly towards the seat assembly 22 to present an inclined surface to a man 32 sitting on the seat 26 who is shown demonstrating the use of the article 20. The man 32 is lacing up a shoe 34 worn on his left foot. Following this, he can reach over to his left to pick up a right shoe 42 which had been taken from a shoe rack and placed on an upper shoe support surface 38 of a rectangular slide-out support board 43 of a shoe support 44. He can then put the right shoe 42 on the foot rest 30, slip his right foot 46 into the shoe 42, and lace it up with his right foot 46 resting on the foot rest 30. Clearly, the article may be used in a similar manner when removing shoes. Shoes which have been removed may be placed on the shoe support 44 and later transferred to the shoe rack. Consequently, the need to bend or stoop to the ground 25 to reach a shoe may be eliminated by using the article 20 and the shoe rack.

Figure 2:
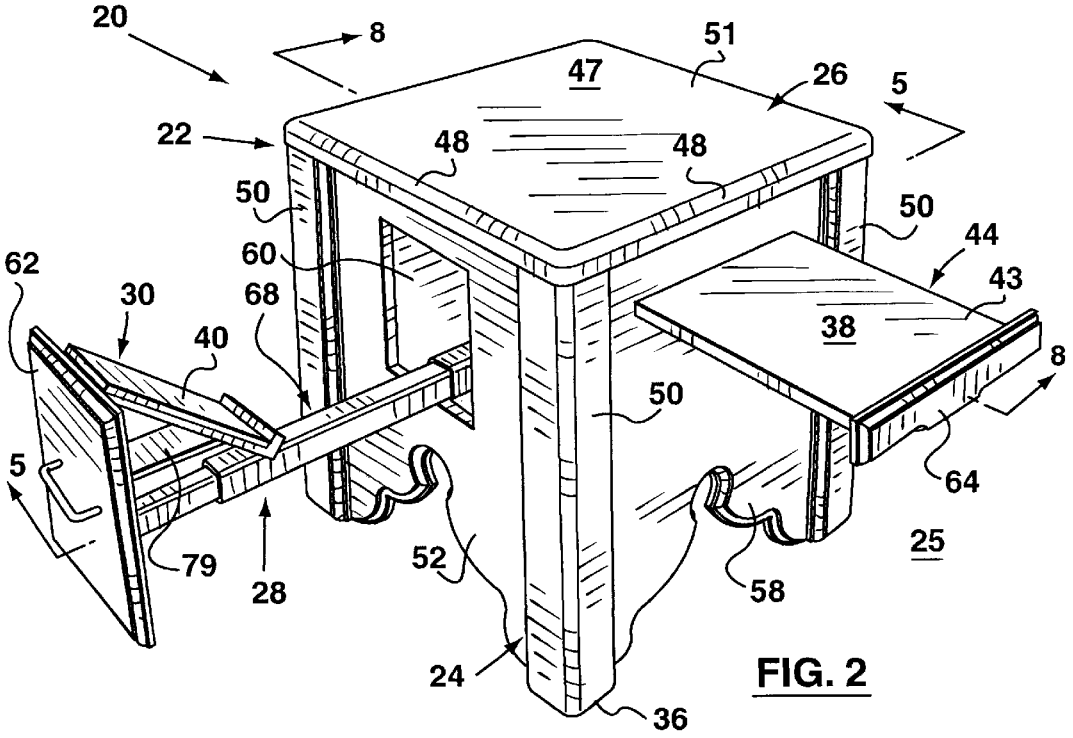
FIG. 2 is another perspective view of the article from the front and left side thereof on its own with the foot rest assembly and shoe support in the same positions as shown in FIG. 1.
Figure 3:
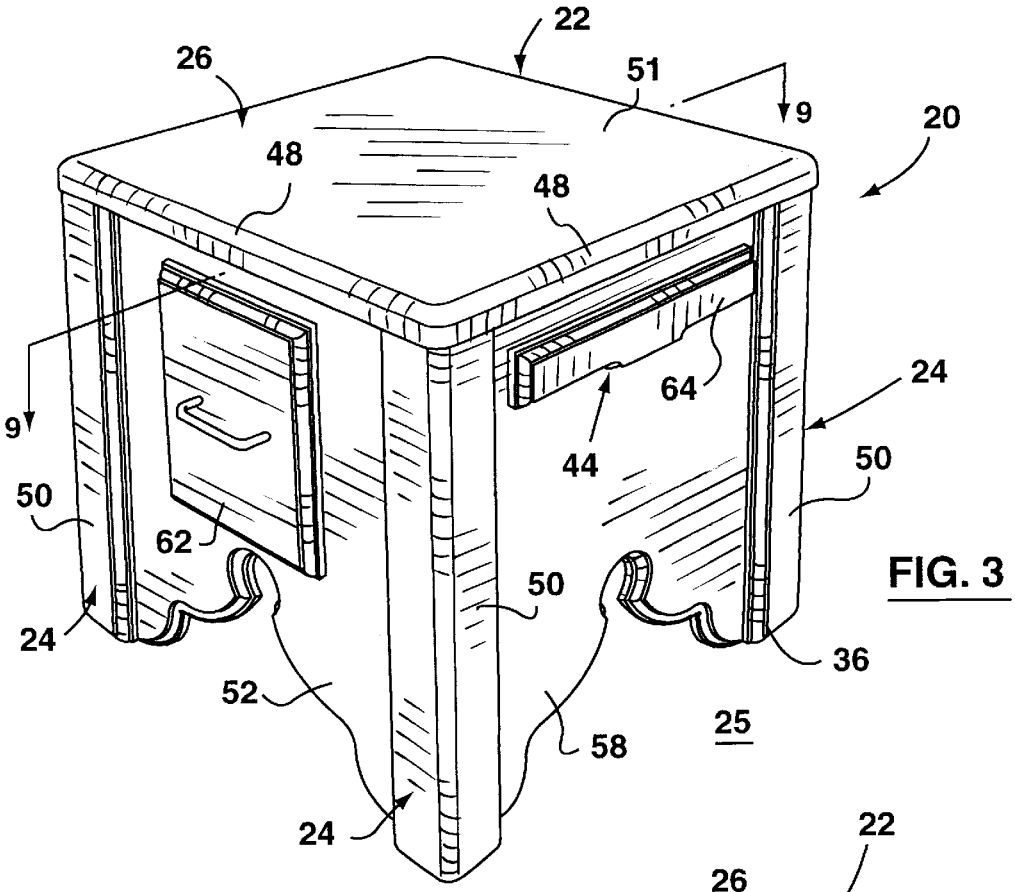
FIG. 3 is a perspective view similar to the view of FIG. 2 of the article showing the foot rest assembly in a retracted position and the shoe support in a retracted non-supporting position.
Figure 8:
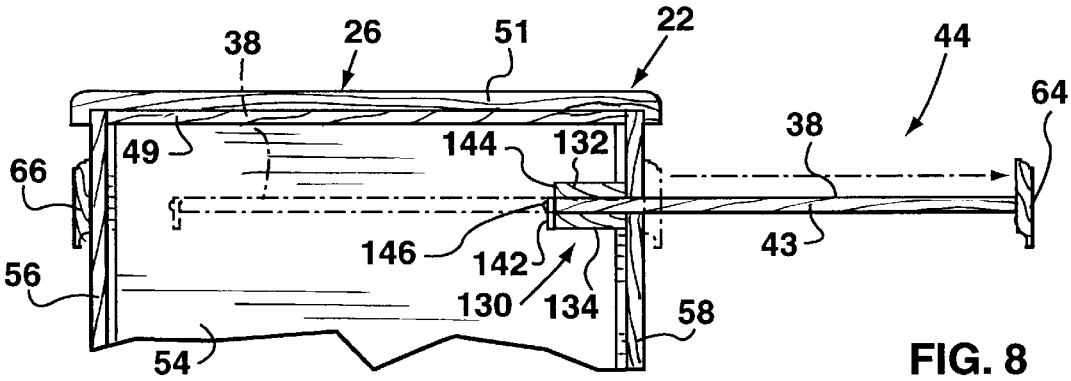
FIG. 8 is a side sectional view of a top portion of the article taken generally along line 8—8 of FIG. 2 showing the shoe support in the supporting position in solid outline and in the non-supporting position in chain dotted outline.
Figure 9:
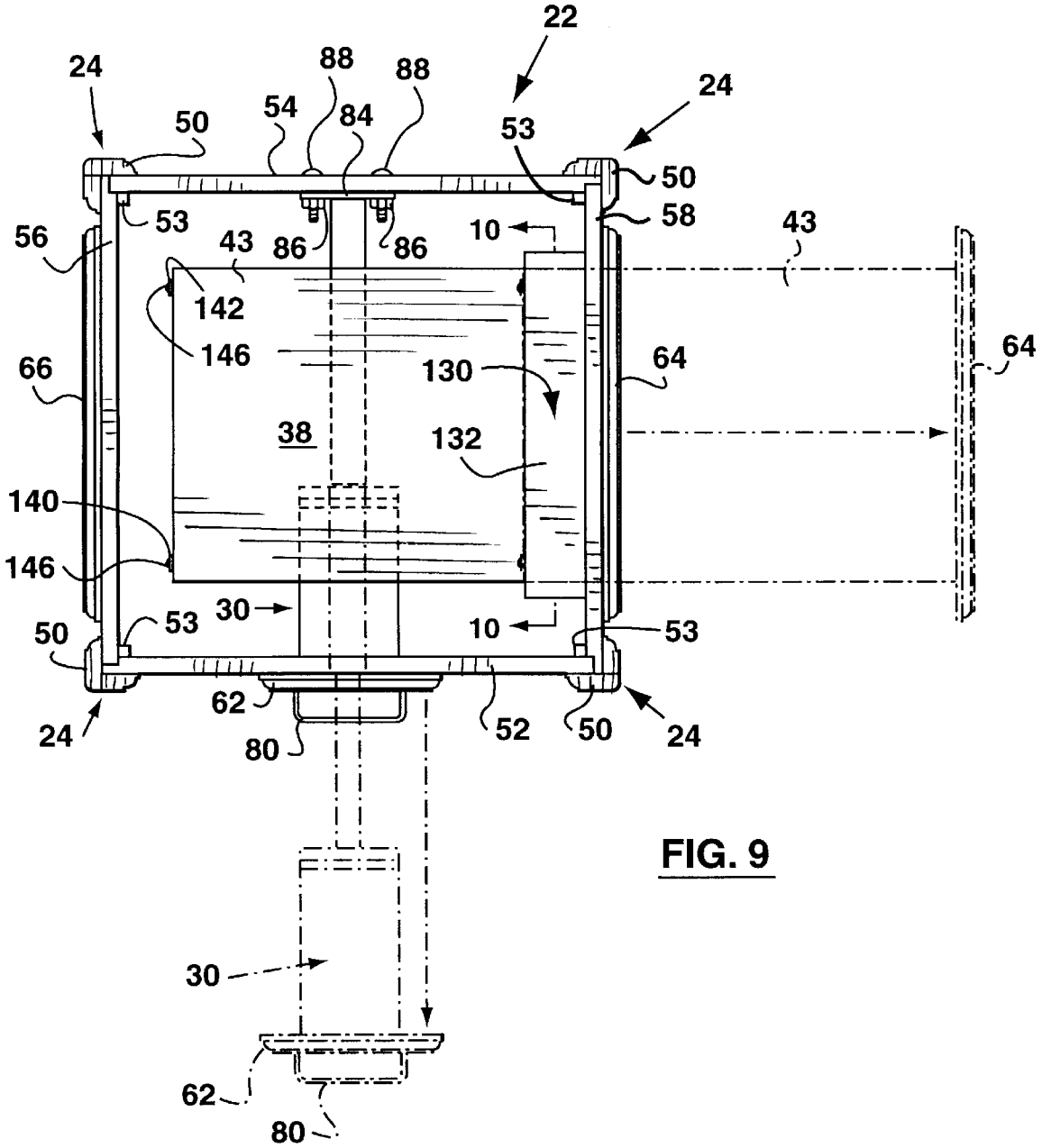
FIG. 9 is a top sectional view taken generally along line 9—9 of FIG. 3.

The article 20 will now be discussed in greater detail with reference mainly to FIG. 2 but with reference also to FIGS. 3–5, 8 and 9. The seat 26 is secured to the top of the support 24 and includes a base panel 49 and a top 51 (FIGS. 5 and 8). The top 51 has a smooth, planar, and generally square top surface 47 and side edges 48 which are chamfered to heighten the visual appeal of the article 20 as well as to minimize sharp edges which may lead to personal injury. Referring briefly now to FIG. 9, the support 24 includes four outer two-piece angled corner uprights 50 and four inner reinforcement vertical posts 53 which contribute to the strength of the support 24. Referring back to FIG. 2, the uprights 50 have rounded vertical corners which, again, are for reducing the number of sharp edges of the article 20 and to heighten its visual appeal.

Figure 4:
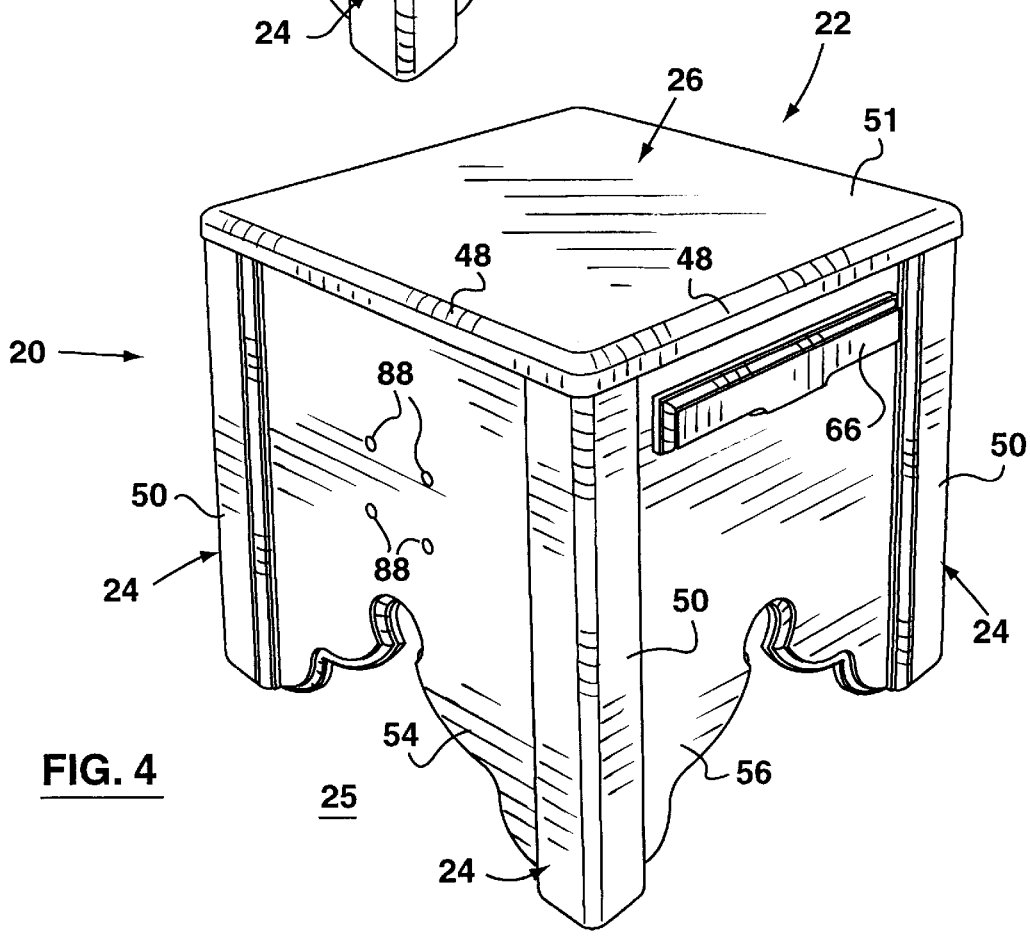
FIG. 4 is a perspective view of the article from a back and a right side thereof with the foot rest assembly and shoe support in the same positions shown in FIG. 3.
Figure 5:
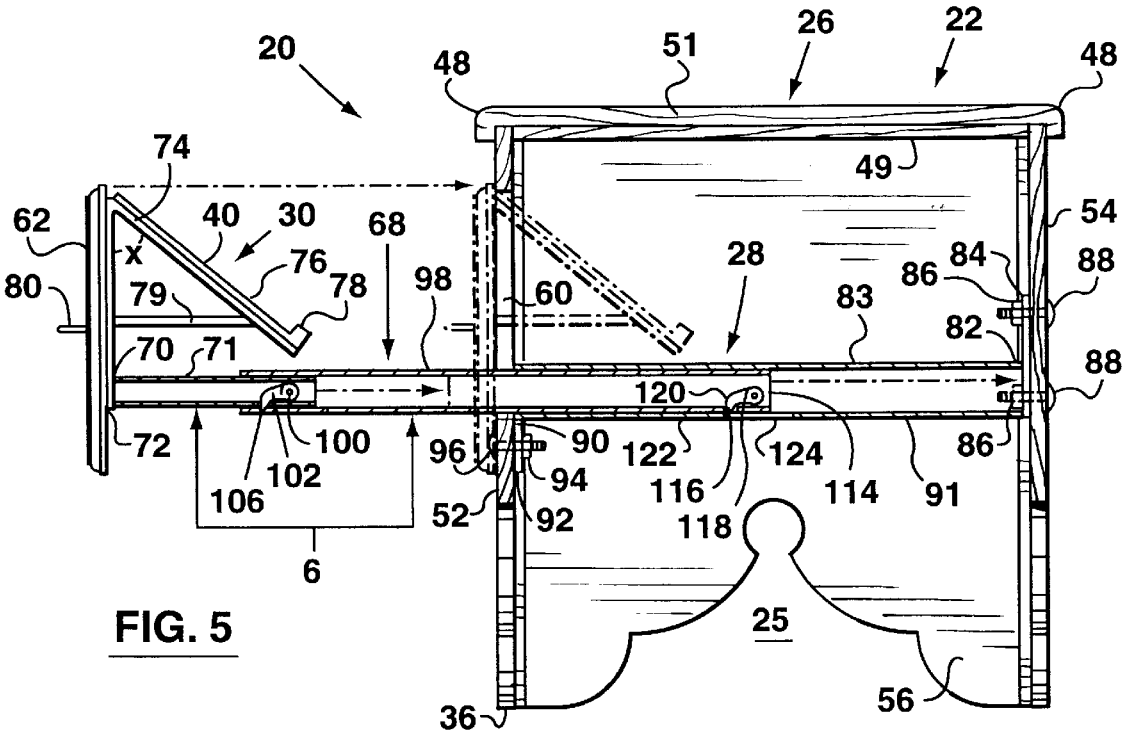
FIG. 5 is a side sectional view taken generally on line 5—5 of FIG. 2 showing the foot rest assembly in the extended position in solid outline, and in the retracted position in chain dotted outline.

The seat assembly 22 includes decorative front and back walls 52, 54, and a pair of decorative side walls 56, 58 extending between the front and back walls 52, 54 (back wall 54 and side wall 56 being shown in FIG. 4). Each wall 52, 54, 56, 58 is attached to and depends downwardly from the seat 26 and is also attached to and extends between a pair of adjacent legs of the support 24. The front wall 52 is cut to provide a square opening 60 through which the foot rest 30 passes when the foot rest assembly 28 is moved between the extended position shown in FIG. 2 and a retracted position, shown most clearly in FIG. 3 (see also chain dotted outline in FIG. 5), in which the shoe rest 30 is located under the seat 26 and within the walls 52, 54, 56, 58. The shoe support 44 can be similarly slid to a retracted non-supporting position also shown in FIG. 3 in which the support board 43 is disposed under the seat (see also chain dotted outline in FIG. 8). Thus, when the article 20 is not in use, the foot rest 30 and other components of the foot rest assembly 28 and the support board 43 can be concealed by the walls 52, 54, 56, 58, a front cover member 62 of the foot rest assembly 28, and a handle or side cover member 64 of the shoe support 44, to make the article 20 look like an attractive furniture stool for display in a home.

Referring to FIG. 4, a similar mock side cover member 66 is permanently attached to the side wall 56 to give a balanced more pleasing look to the article 20.

The foot rest assembly 28 and its operation will now be described in more detail with reference to FIGS. 5 to 7.

As seen in FIG. 5, the foot rest assembly 28 includes a telescoping metal arm 68 extending in a straight, horizontal, and forward direction from the back 54 of the seat assembly 22. Moving the foot rest assembly 28 to the extended position (shown in solid outline) requires extending the arm 68. Similarly, moving the foot rest assembly 28 to the retracted position (shown in chain dotted outline) requires retracting the arm.

The arm 68 has a forward first end 70, being a forward end of a square tubular innermost arm segment 71, rigidly coupled to the foot rest 30 by being welded orthogonally to a lower portion of a metal foot rest mounting plate 72. The foot rest mounting plate 72 has a top end which is integrally formed with a top end of a metal base plate 74 of the foot rest 30 to form an acute angle "X". Adhered to an inclined surface of the base plate 74 is a rectangular rubber pad 76 of the foot rest 30 which adds grip to the inclined surface 40. An elongated narrow plastic strip 78 is affixed horizontally to a lower end portion of the rubber pad 76 to provide a straight bottom ledge to prevent a person's foot from sliding downwardly off the foot rest 30 when the article is being used. A horizontal metal brace member 79 is welded at forward and rearward ends thereof to the shoe rest mounting plate 72 and base plate 74, respectively. The brace member 79 provides reinforcement to the foot rest 30 to prevent changes in its angle of inclination through prolonged use of the article 20.

The front cover member 62 is secured to the foot rest mounting plate 72 by screws (not shown). A handle 80 is attached by screws (also not shown) to a forward side of the front cover member 62 and is used for extending and retracting the foot rest assembly 28.

The arm 68 also has a rearward second end 82, being a rearward end of a fixed square tubular outer arm segment 83, rigidly coupled to the seat assembly 22. The rearward second end 82 is welded orthogonally to a metal back mounting plate 84 which is secured to the back wall 54 using four sets of nuts 86 and bolts 88. The bolts 88 are inserted through apertures drilled through the back wall 54 and the back mounting plate 84, and tightened using corresponding nuts 86 (see also FIG. 4). For added support, a forward end 90 of a bottom side 91 of the outer tubular arm segment 83 is welded at a right angle to a front mounting plate 92. The front mounting plate 92 is attached to the front wall 52 using two sets of laterally spaced nuts 94 and bolts 96 (only one nut 94 and one bolt 96 being shown in FIG. 5) in a manner similar to the attachment of the back mounting plate 84 to the back wall 54.

As should be apparent from the above description, the outer tubular arm segment 83 is fixed in place within the four walls 52, 54, 56, 58 of the seat assembly 20 22, being welded at its ends to the mounting plates 92, 84, respectively. A square tubular intermediate arm segment 98 is slidable inside the fixed outermost arm segment 83 between forward and rearward limits. Similarly, the innermost arm segment 71 is slidable within the intermediate arm segment 98 between forward and rearward limits.

Figure 6:
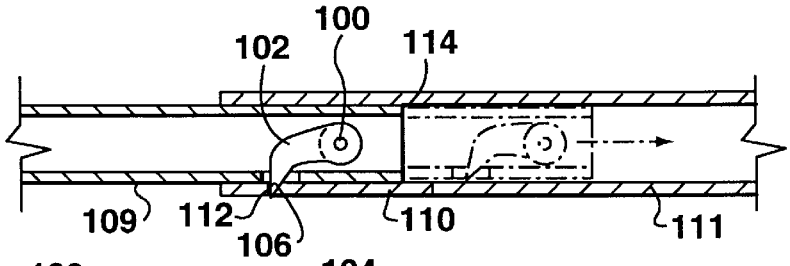
FIG. 6 is a side sectional view of a portion of a telescoping arm of the foot rest assembly, which portion is indicated generally by arrows 6 in FIG. 5, the portion being drawn to a larger scale than the scale of FIG. 5.
Figure 7:
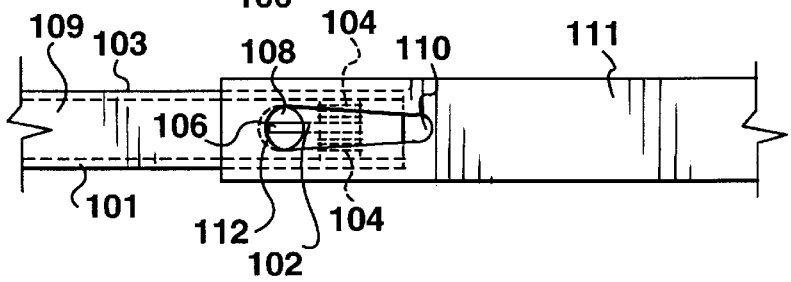
FIG. 7 is a bottom view of the portion of the telescoping arm indicated generally by arrows 6 in FIG. 5 and drawn to the same scale as the scale of FIG. 6.

As can be seen with reference to FIGS. 6 and 7, the innermost arm segment 71 has a pin 100 mounted to opposed sides 101, 103 of the arm segment 71 at a rearward end portion thereof to extend laterally between the sides 101, 103. A hooked cam 102 is pivotally mounted on the pin 100 between two equal rows of steel washers 104 (only a couple of washers 104 being labelled for simplicity in FIG. 7). The washers 104 are retained on the pin 100, one row on each side of the cam 102 for locating the cam 102 centrally between the two opposed sides 101, 103. As such, a hooked portion 106 of the cam 102 is positioned to drop through a centred bottom aperture 108 in a bottom side 109 of the innermost arm segment and into an elongated slot 110 in a bottom side 111 of the intermediate arm segment 98. Forward travel of the innermost arm segment 71 is limited by the hooked portion 106 engaging a forward end 112 of the elongated slot 110. From this forward limit of travel, the innermost arm segment 71 can be slid rearwardly into the intermediate arm segment 98 until the front cover member 62 engages the front wall 52 around the opening 60.

Referring again to FIG. 5, the intermediate arm segment 98 is slidable within the outermost arm segment 83 in a similar fashion. Forward travel is limited by a, hooked portion 116 of a pivoting cam 118 dropping through a centred aperture 120, in a bottom side 122 of the intermediate arm segment 98, and through an elongated slot 124 provided in the bottom side 91 of the outermost arm segment 83, into engagement with a forward end of the elongated slot 124. Though not fully shown, the cam 118 like the cam 102, is pivotally mounted on a laterally extending pin between two equal rows of washers mounted on the pin. Rearward travel of the intermediate arm segment 98 is limited by a rearward end 114 engaging the back mounting plate 84.

The foot rest assembly 28 can therefore be moved to the extended position from the retracted position by pulling the handle 80 forwardly of the seat assembly 22 to slide the innermost and intermediate arm segments 71, 98 to their respective forward limits. Pushing the handle 80 rearwardly will cause the arm segments 71, 98 to be pushed rearwardly towards their respective rearward limits, the foot rest assembly 28 thereby returning to the retracted position.

Figure 10:
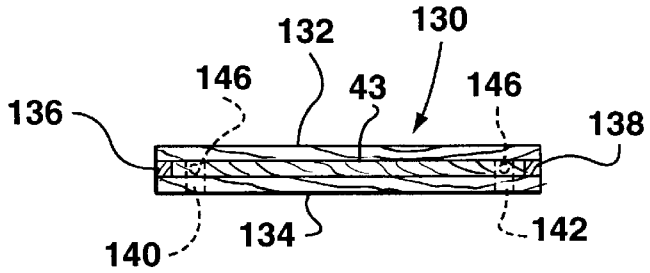
FIG. 10 is a side sectional view taken generally along line 10—10 of FIG. 9 showing a slide bearing and the shoe support of the article.

The shoe support 44 will now be described in detail with reference to FIGS. 8–10. As mentioned above, the support board 43 of the shoe support 44 has an upper shoe support surface 38 and is slidably retained by a rectangular slide bearing 130 of the seat assembly 22 within limits. The slide bearing 130 is disposed below the seat 26 and includes top, bottom, forward, and rearward rectangular pieces 132, 134, 136, 138, respectively, attached together to define a rectangular slide passage. The slide bearing 130 is attached to an inner surface of the side wall 58 such that the slide passage is in communication with a similarly dimensioned rectangular opening in the side wall 58. The shoe support 44 includes a pair of metal abutment plates 140, 142 attached at right angles to an inner end face 144 of the support board 43 using screws 146, so as to extend downwardly from the support board 43. The support board 43 is slidable laterally in the slide bearing 130 between a non-supporting position (shown in chain dotted outline in FIG. 8) and a shoe supporting position (shown in solid outline in FIG. 8) by grasping the side cover member 64. In the non-supporting position, the shoe support surface 38 is hidden under the seat 26 and the side cover member 64 engages the side wall 58. In the shoe supporting position, which is spaced laterally outwardly from the non-supporting position, the shoe support surface 38 is exposed and the abutment plates 140, 142 engage the bottom piece 134 of the slide bearing 130, whereby a major portion of the shoe support 44 extends laterally outwardly of the seat assembly 22 at a selected location spaced from the bottom end 36 so as to be within reach of a person sitting on the seat 26. The amount of the shoe support surface 38 which is exposed is adjustable in that it is possible to slide the support board 43 out only part-way and still have enough of the shoe support surface 38 exposed for use in supporting a shoe or shoes.

FIG. 9 is a top view of the article 20 with the seat 26 removed to further illustrate the relative positions of the foot rest assembly 28 and the shoe support 44. The foot rest assembly 28 and shoe support 44 are shown in the extended and shoe supporting positions, respectively, in chain dotted outline. In solid outline, the foot rest assembly 28 and shoe support 44 are shown in the retracted and non-supporting positions, respectively. Thus, in the latter case, the foot rest 30 and shoe support surface 38 are each disposed under the seat 26 with the support board 43 being above the foot rest 30.

Clearly, the relative dimensions and location of components of the article may be varied within reasonable limits to provide an article which is suitable for use by people of different sizes and preferences. For example, the shoe support 44 may be positioned to slide-out laterally from a right side of the seat assembly 22 rather than a left side, as shown in the preferred embodiment. Also, the support board 44 and foot rest assembly 28 can be positioned higher or lower or made to slide out more or less within reasonable limits. The number of arm segments of the arm may be varied. The foot rest 30 may be enlarged to provide an inclined surface 40 which is suitable for resting both feet thereon. A seat cushion can be placed on or attached to the top 51 of the seat 26 for greater comfort. It should be understood that the foregoing description is by way of example only and shall not be construed to limit the scope of the invention as defined by the following claims.

What is claimed is:

1. A seat and footrest assembly for use in putting on and removing a shoe, the assembly including:

a seat having a support for resting on the ground and a seat surface thereabove on which a person can sit, a horizontally extending arm assembly comprising a three piece telescopic arm having a rear portion fixed in the support below the seat surface and a forward portion extendable in a horizontal direction from a rear position in the support to a forward position projecting therefrom in cantilevered form, a footrest fixed to the forward portion of the horizontally extendable arm assembly and movable between a rear position within the seat and a forward position in front of the seat to receive the foot of a person sitting on the seat surface, said footrest comprising a one piece plate formed of a vertical mounting plate and a base plate extending downwardly and rearwardly from a top end of the mounting plate, said mounting plate having a rear wall fixed to said forward portion of the arm assembly and forming a generally right triangle shape therewith;

said mounting plate further having a front cover mounted on a front surface of the mounting plate so as to enclose the foot rest within the seat and give the appearance of a closed drawer face when not in use, and a brace member fixed to a rear surface of the mounting plate and to a front surface of the base plate to prevent bending such that the footrest base plate is rigidly supported on the arm assembly for securely supporting the person's foot.

2. A seat and footrest assembly according to claim 1 also including a shelf slidably mounted in support for horizontal lateral movement between a retracted position within the support and a laterally extending position to receive a shoe for subsequent use by a person sitting on the seat surface.

* * * * *